US010934123B2

(12) United States Patent
Piantoni et al.

(10) Patent No.: US 10,934,123 B2
(45) Date of Patent: Mar. 2, 2021

(54) UNIT FOR APPLYING TABS TO A CHASSIS WEB

(71) Applicant: GDM S.p.A., Bologna (IT)

(72) Inventors: Matteo Piantoni, Albino (IT); Valerio Soli, Bologna (IT); Marco Rosani, Vailarate (IT); Federico Tordini, Pedrengo (IT)

(73) Assignee: GDM S.P.A., Bologna (IT)

( * ) Notice: Subject to any disclaimer, the term of this patent is extended or adjusted under 35 U.S.C. 154(b) by 30 days.

(21) Appl. No.: 15/767,180

(22) PCT Filed: Oct. 20, 2016

(86) PCT No.: PCT/IB2016/056316
§ 371 (c)(1),
(2) Date: Apr. 10, 2018

(87) PCT Pub. No.: WO2017/068525
PCT Pub. Date: Apr. 27, 2017

(65) Prior Publication Data

US 2018/0290855 A1 Oct. 11, 2018

(30) Foreign Application Priority Data

Oct. 23, 2015 (IT) ..... 102015000064660

(51) Int. Cl.
*B65H 35/08* (2006.01)
*B65H 29/24* (2006.01)
*B65H 39/14* (2006.01)

(52) U.S. Cl.
CPC ..... *B65H 35/08* (2013.01); *B65H 29/241* (2013.01); *B65H 39/14* (2013.01);
(Continued)

(58) Field of Classification Search
CPC .. Y10T 83/2185; B26D 7/1863; B26D 7/018; B26F 1/384; B65H 35/08
(Continued)

(56) References Cited

U.S. PATENT DOCUMENTS 6,730,189 B1 * 5/2004 Franzmann ..... A61F 13/15756 156/265
7,811,403 B2 * 10/2010 Andrews ..... A61F 13/15756 156/238

(Continued)

FOREIGN PATENT DOCUMENTS

WO WO2014087293 A1 6/2014

OTHER PUBLICATIONS

International Search Report dated Jan. 30, 2017 from counterpart PCT App No. PCT/IB2016/056316.

(Continued)

*Primary Examiner* — Laura M Lee
(74) *Attorney, Agent, or Firm* — Shuttleworth & Ingersoll, PLC; Timothy J. Klima

(57) ABSTRACT

A unit for applying first and second tabs, obtained from first and second webs, to a chassis web includes an applicator drum rotatable about an axis and including a main body. A plurality of carriers is movable between a lowered position close to the axis and a raised position away from the axis, each including a suction portion. A first carrier first suction and non-suction portions aligned along the axis. A second carrier includes second suction and non-suction portions aligned along the axis. The first suction portions alternate with the second non-suction portions and the first non-suction portions alternate with the second suction portions. A first system holds the first web on the applicator drum upstream of a cutting device. A second system holds the second web on the drum upstream of the cutting device.

7 Claims, 6 Drawing Sheets

(52) U.S. Cl.
CPC ..... *B65H 2301/4493* (2013.01); *B65H 2301/44512* (2013.01); *B65H 2301/44522* (2013.01); *B65H 2301/51536* (2013.01); *B65H 2301/515323* (2013.01); *B65H 2404/40* (2013.01); *B65H 2404/654* (2013.01); *B65H 2404/655* (2013.01); *B65H 2406/331* (2013.01); *B65H 2406/3452* (2013.01); *B65H 2701/1924* (2013.01); *B65H 2801/57* (2013.01); *Y10T 83/2185* (2015.04)

(58) Field of Classification Search
USPC ..... 83/343, 346
See application file for complete search history.

(56) References Cited

U.S. PATENT DOCUMENTS 8,016,972 B2 * 9/2011 Andrews ..... A61F 13/15577 156/250
8,679,282 B2 * 3/2014 Piantoni ..... A61F 13/15756 156/250
8,790,232 B2 * 7/2014 Pastrello ..... A61F 13/15756 493/379
9,433,538 B2 * 9/2016 Pagel ..... A61F 13/15723
2003/0066609 A1 * 4/2003 Calvert ..... A61F 13/15772 156/362
2007/0256777 A1 11/2007 Andrews
2008/0276439 A1 * 11/2008 Andrews ..... A61F 13/15577 29/428
2009/0242098 A1 * 10/2009 Handziak ..... B32B 37/144 156/73.1
2010/0192739 A1 * 8/2010 Piantoni ..... A61F 13/15756 83/26
2010/0326796 A1 * 12/2010 Walsh ..... A61F 13/15764 198/579
2012/0190523 A1 * 7/2012 Pastrello ..... A61F 13/15756 493/343
2012/0310198 A1 * 12/2012 Sablone ..... A61F 13/15756 604/385.01

OTHER PUBLICATIONS

Japanese Office Action dated Aug. 25, 2020 from counterpart Japanese App No. 2018-520466.

* cited by examiner

UNIT FOR APPLYING TABS TO A CHASSIS WEB

This application is the National Phase of International Application PCT/IB2016/056316 filed Oct. 20, 2016 which designated the U.S.

This application claims priority to Italian Patent Application No. 102015000064660 filed Oct. 23, 2015, which application is incorporated by reference herein.

TECHNICAL FIELD

This invention relates to a unit for applying tabs to a chassis web intended in particular for machines for forming absorbent sanitary articles such as nappies, to which express reference is hereinafter made without losing in generality.

BACKGROUND ART

Absorbent sanitary articles are known which comprise a main body, generally defined as a piece of a composite web and having a main direction of extension.

The main body of the article has a front end portion, also referred to simply as "front" in the jargon of the trade and which, in use, as this implies, covers a front part of the wearer's body, and a back end portion, also referred to simply as "back" in the jargon of the trade and which, in use, as this implies, covers a back part of the wearer's body.

Prior art absorbent articles comprise a pair of side wings, which may, if necessary, consist of two or more connected parts, which extend from opposite sides of the front end portion, and a pair of side wings, which may, if necessary, consist of two or more connected parts, which extend from opposite sides of the back end portion.

The back wings are generally provided with fastening or joining elements, commonly referred to as "tabs" to engage the corresponding front wings in order to fasten the article round the user's waist.

Generally speaking, therefore, each back wing is made up, for example, of a panel and a corresponding tab connected to the panel and projecting therefrom so that it can, in use, be attached to a corresponding front wing of the nappy.

As is known, the back wings are obtained, during nappy production, from a continuous chassis web which is cut into pieces.

The pieces are then attached to the main body, or more in general, during assembly, to one layer of the composite web making up the main body, as it moves along a feed path.

Before the continuous web, or chassis web, is cut into pieces, the fastening elements are applied to it at suitably spaced intervals.

Generally, the right- and left-hand tabs, considering their positions on the nappy when worn by the user, are obtained from two distinct webs which are cut into pieces.

An applicator drum feeds the two webs which are held down by vacuum pads and which, after being cut into pieces, are positioned on the chassis web by the same vacuum pads.

Usually, the two webs are fed and cut alternately. Thus, while one web is moved forward, the other remains stationary and is held in place by the vacuum pads passing underneath it.

The webs from which the fastening elements are obtained are fed to a cutting station where they are held in place by the applicator drum by means of vacuum pads and downstream of which the pieces are fed onto the chassis web.

The speed of rotation of the applicator drum is set by the feed speed of the chassis web, that is to say, by the longitudinal dimension of the main body that will be obtained from the chassis web.

The feed speed of the web from which the fastening elements are obtained, is determined by the longitudinal extension of the tabs, considering a feed direction of the web itself, and is less than the rotation speed of the applicator drum.

When the web is held by the drum and before it is cut into individual tabs, the web is subjected to tensions which may lead to unwanted movement of the fastening elements on the corresponding vacuum pads.

These movements may cause the piece of web to be misplaced on the vacuum pad and consequently applied on the chassis web in an incorrect configuration.

This problem is particularly strongly felt in the case of shaped tabs, whose incorrect placement in the finished nappy is unacceptable.

DISCLOSURE OF THE INVENTION

In this context, the main purpose of this invention is to propose a unit for applying tabs to a continuous web to overcome the above mentioned disadvantages.

The aim of this invention is to provide a unit for applying tabs to a chassis web which allows the tabs to be precisely positioned on the chassis web.

The technical purpose and aims specified are substantially achieved by a unit for applying tabs to a chassis web according to the present disclosure.

BRIEF DESCRIPTION OF THE DRAWINGS

Further features and advantages of this invention are more apparent in the non-limiting description below, with reference to a preferred but non-exclusive embodiment of a unit for applying tabs to a chassis web as illustrated in the accompanying drawings, in which.

DETAILED DESCRIPTION OF PREFERRED EMBODIMENTS OF THE INVENTION

Figure 1:
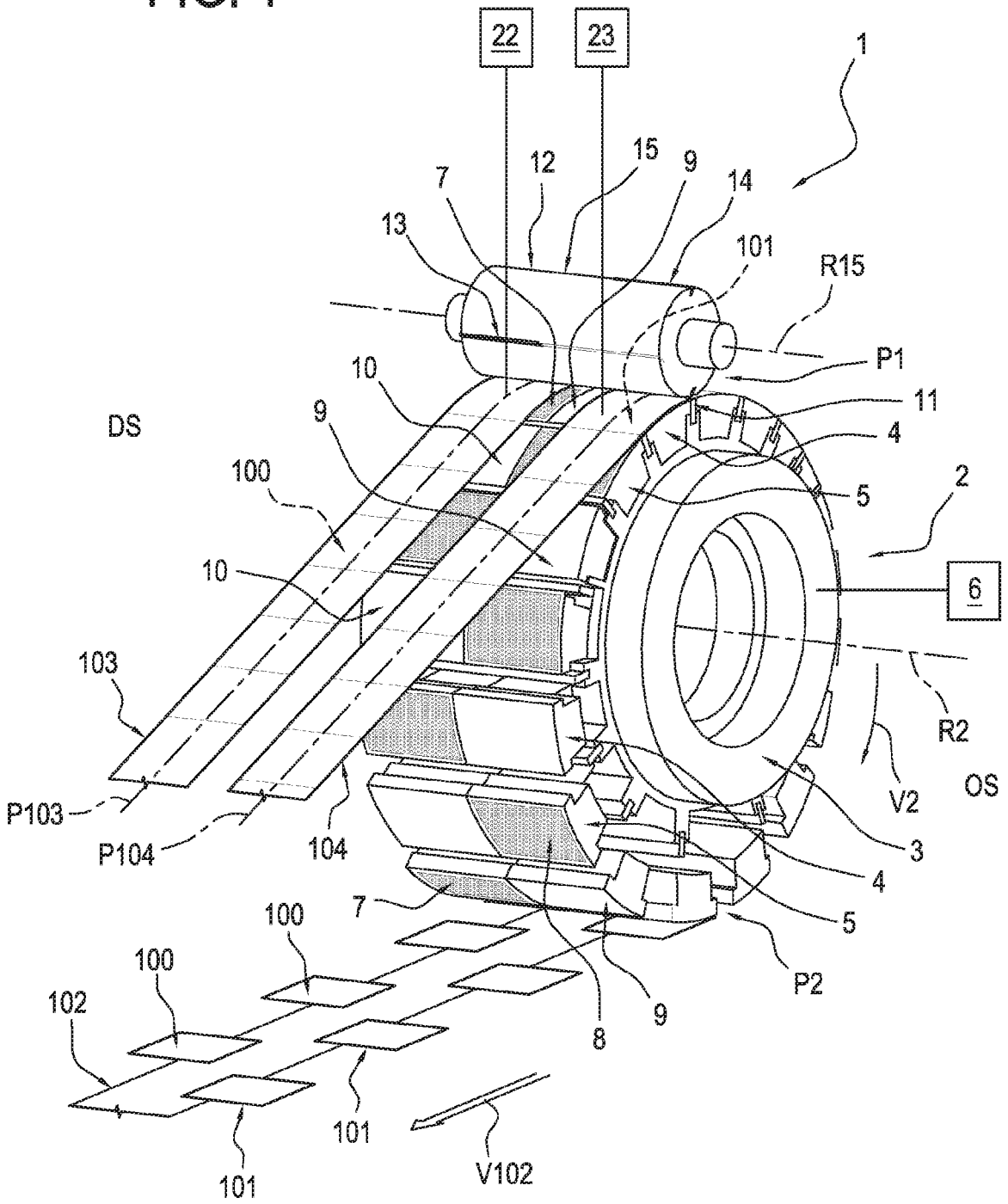
FIGS. 1 to 4 show a unit for applying tabs in a schematic sequence of operating steps, illustrated in schematic perspective views, partly in blocks and with some parts cut away for greater clarity, and substantially corresponding to the configuration of FIG. 2.

With reference to the accompanying drawings, the numeral 1 denotes a unit for forming and spacing tabs from respective webs according to this invention, as will become clearer as this description continues.

In the preferred embodiment illustrated, the unit 1 is also designed to apply the tabs to a chassis web according to this invention.

For simplicity, reference is also made only to a unit for applying the tabs as a preferred example embodiment of the invention.

Generally speaking, as mentioned above the invention relates to a unit for forming and spacing first and second tabs obtained, respectively, from a first web and a second web.

The unit 1 is, in particular, designed to apply first and second tabs 100, 101 to a chassis web 102 moving forward in a direction V102.

As will become clearer as this description continues, the first tabs 100 are obtained from a first continuous web 103, while the second tabs 101 are obtained from a second continuous web 104.

The unit 1 is preferably intended for machines for forming absorbent sanitary articles such as nappies, to which express reference is hereinafter made without losing in generality.

Each nappy has a front end portion, also referred to simply as "front" in the jargon of the trade and which, in use, as this implies, covers a front part of the wearer's body, and a back end portion, also referred to simply as "back" in the jargon of the trade and which, in use, as this implies, covers a back part of the wearer's body.

Absorbent articles of known type comprise a pair of side wings, which may, if necessary, consist of two or more connected parts, which extend from opposite sides of the front end portion, and a pair of side wings, which may, if necessary, consist of two or more connected parts, which extend from opposite sides of the back end portion.

The back wings are generally provided with fastening or joining elements, commonly referred to as "tabs" to engage the corresponding front wings in order to fasten the article round the user's waist.

According to this invention, the unit 1 is designed to form the back wings which are obtained in known manner, not described, by cutting the chassis web 102 into pieces after the tabs 100, 101 have been applied to it.

As will become clearer as this description continues, the applicator unit 1 preferably allows cutting, picking up, transporting, spacing and transferring the tabs of the back wings of the nappies before they are separated from each other by cutting.

Generally speaking, the panels that will form the back wings have two parallel sides: a first side designed to be connected to the main body of the nappy and a second side, opposite the first, designed to receive the fastening elements and, in practice, to engage the corresponding front wing when the nappy is worn.

The fastening elements, or tabs 100, 101, are applied on the chassis web 102 in an alternating succession on the first and second sides according to the pattern shown in the accompanying drawings; this tab positioning configuration is commonly referred to also as intermittent, offset configuration.

The unit 1 comprises a drum 2 for forming and spacing the tabs and rotatable about an axis of rotation R2 in a direction of rotation V2.

As mentioned, the drum 2 is also designed to apply the tabs on a chassis web.

The drum 2 comprises a main body 3 and a plurality of first and second mobile carriers 4, 5, preferably angularly spaced along a lateral surface of the main body 3 and alternated with each other. As illustrated, each second carrier 5 follows a respective first carrier 4 consecutively in the direction of rotation V2.

The forming and spacing drum 2 is designed to move the first web 103 and the second web 104 arranged in juxtaposition along a lateral surface of the drum 2 itself during a rotation about an axis of rotation R2.

The carriers 4, 5, also called "vacuum pads" in the jargon of the trade, are preferably movable between a lowered position close to the axis of rotation R2 and a raised position away from the axis of rotation R2 in order to feed the first and second webs 103, 104 and/or the first and second tabs 100, 101 and apply them on the chassis web 102.

The unit 1 comprises a system, schematically represented as a block 6, for moving the carriers 4, 5 from the lowered position to the raised position and vice versa.

In practice, to obtain the required spacing at a placement point P2, in this case located, for example, 180° after a pickup/cutting point P1, the vacuum pads 4, 5 are made to gradually move translationally to the higher radial level, preferably by means of a single lift cam, not illustrated, and then made to return to the lowered position to pick up the next tab after the corresponding tab 100, 101 has been placed on the chassis web 102 from which the back wings will subsequently be cut.

Each carrier 4 comprises a suction seat 7 for the first continuous web 103 and for the first tabs 100 after they have been cut from the web 103.

Each carrier 5 comprises a suction seat 8 for the second continuous web 104 and for the second tabs 101 after they have been cut from the web 104.

Each first carrier 4 comprises a first suction portion, or active portion defining the respective suction seat 7 and a first non-suction portion or passive portion 9 aligned along the axis of rotation R2.

Each second carrier 5 comprises a second suction portion, or active portion defining the respective suction seat 8 and a second non-suction portion or passive portion 10 aligned along the axis of rotation R2.

In practice, the active portions have suctions means for holding the webs and the passive portions do not.

Hereinafter, the first suction seats and the first suction portions are denoted without distinction by the numeral 7 and the second suction seats and second suction portions are denoted without distinction by the numeral 8.

Each first carrier 4 is preferably divided axially into the portions 7 and 9, which are the same except for the suction.

Each second carrier 5 is preferably divided axially into the portions 8 and 10, which are the same except for the suction.

Looking at the drum 2, the first suction portions 7 of the carriers 4 are alternated with the second, non-suction portions 10 of the carriers 5 and the first non-suction portions 9 are alternated with the second, suction portions 8 along the outside surface of the drum 2 itself.

In other words, the positions of the active and passive portions of two consecutive carriers 4, 5 are inverted with each other along a placement direction parallel to the axis R2 in such a way as to alternate an active portion 7, 8 and a passive portion 9, 10 along a stretch of the lateral surface on which the first web 103 or the second web 104 is moving during the rotation of the drum 2.

Preferably, the vacuum pads 4, 5 are hollow and, in practice, allow creating the vacuum necessary to transport the tabs 100, 101 in the respective seats 7, 8 alternately on one half of the drum 2 towards the drive side DS of the unit 1 itself and one half towards the operator side OS.

The forming and spacing unit comprises cutting means adapted for arrangement in operating configuration with the forming and spacing drum 2 to cut the first and second tabs 100, 101 alternately and in sequence from the first web 103 and the second web 104, respectively.

In the preferred embodiment illustrated, the unit 1 comprises a plurality of anvils 11 mounted on the main body 3 and interposed between consecutive first and second carriers 4, 5, that is, alternated with the mobile carriers 4, 5.

The anvils 11, which are defined, for example, by metal inserts, extend preferably for the full axial length of the carriers 4, 5.

The forming and spacing drum 2 is provided with the anvils 11, each of which is interposed between two consecutive carriers 4, 5, and the cutting means are adapted for arrangement in operating configuration in contact with the anvils 11 in order to cut the first and second tabs 100, 101 alternately from the first web 103 and from the second web 104, respectively.

The unit 1 comprises a cutting device 12 operating at the applicator drum 2 and acting in conjunction with the anvils 11 to cut the first continuous web 103 into first tabs 100 and the second continuous web 104 into second tabs 101.

The cutting device 12 comprises a plurality of first blades 13, two in the example illustrated, to cut the first web 103 and a plurality of second blades 14, two in the example illustrated, to cut the second web 104.

The cutting device 12 comprises a cutting roller 15, which mounts the blades 13 and 14 and which is rotatable about an axis R15 parallel to the axis R2 in a direction V15.

The blades 13 operate along a first feed path P103 of the web 103 and the blades 14 operate along a second feed path P104 of the web 104.

In use, the blades 13 and 14 cooperate alternately with consecutive anvils 11 to cut the webs 103 and 104, as explained in more detail below.

More specifically, the blades 13 are preferably spaced on the roller 15 by a spacing corresponding to twice the length of the vacuum pads 4, 5 measured along a circumference of the drum 2, in such a way as to cut the web 103 every two anvils 11, that is, skipping one anvil 11.

Similarly, the blades 14 are preferably spaced on the roller 15 by a spacing corresponding to twice the length of the vacuum pads 4, 5 measured along a circumference of the drum 2, in such a way as to cut the web 104 every two anvils 11, that is, skipping one anvil 11.

In practice, the machine 1 comprises a multi-blade knife 13, 14, 15 which is coupled with the anvils 11 on the side DS and on the side OS alternately.

Figure 6:
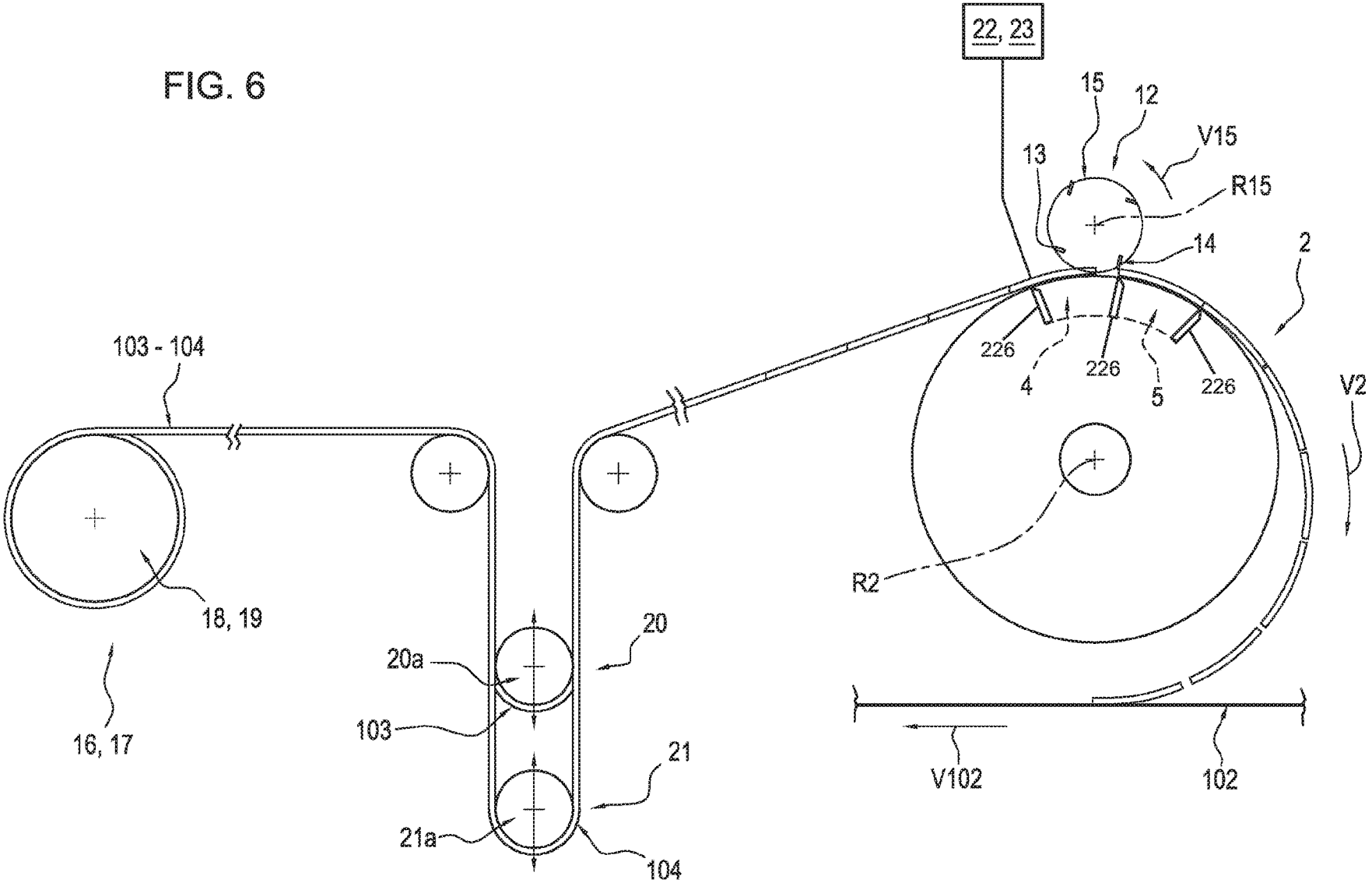
FIG. 6 shows a plurality of opposing blades.

In an alternative embodiment shown in FIG. 6, the forming and spacing drum 2 is provided with a plurality of opposing blades 226, each interposed between two consecutive carriers 4, 5.

The cutting means are adapted for arrangement in operating configuration in contact with the opposing blades 226 to cut the first and second tabs 100, 101 alternately and in sequence from the first web 103 and the second web 104, respectively, according to a "scissor-like" cutting method.

Figure 7:
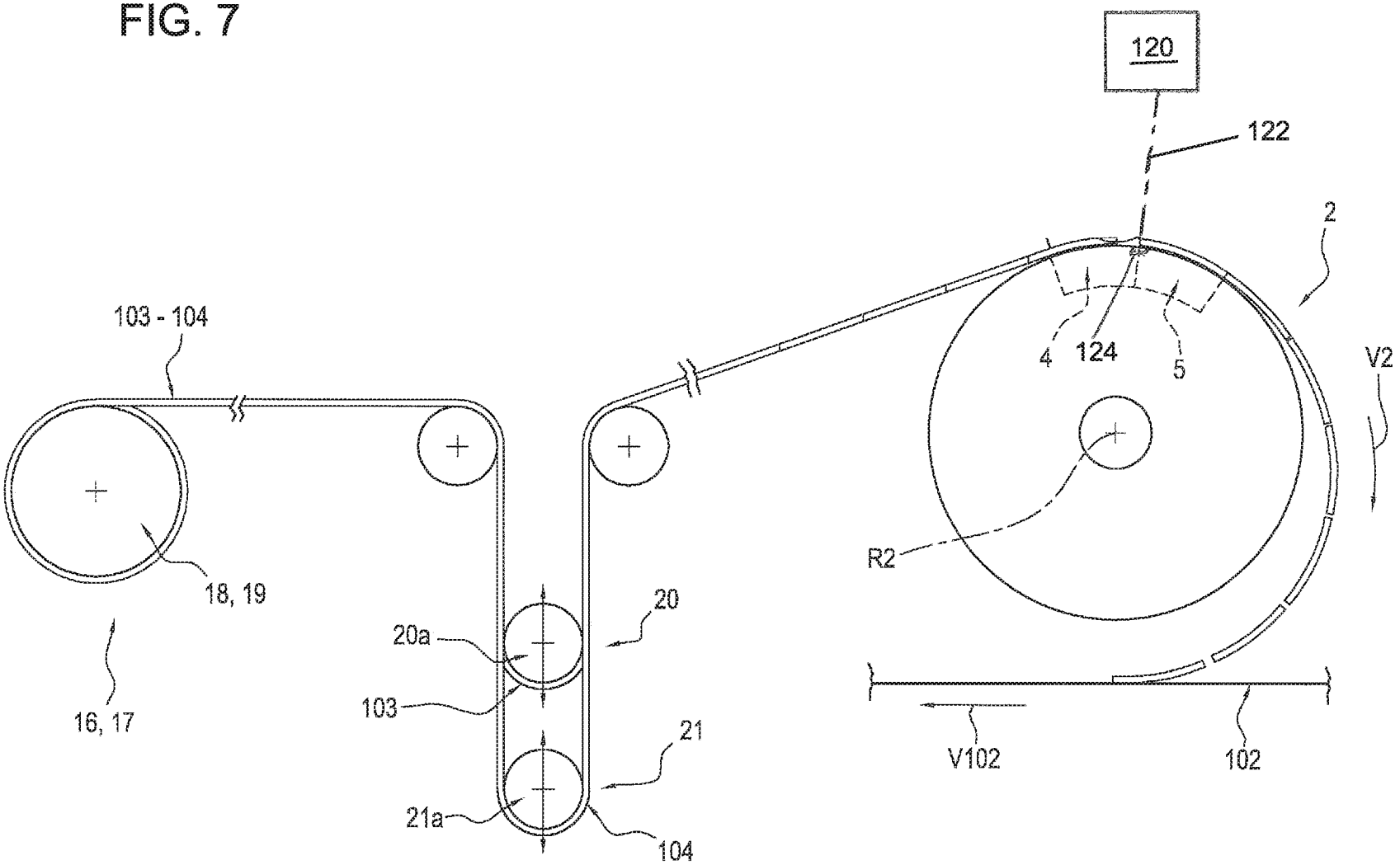
FIG. 7 shows a laser cutting system.

In an alternative embodiment shown in FIG. 7, the forming and spacing drum 2 is equipped with a plurality of seats 124, each interposed between two consecutive carriers 4, 5 and the cutting means comprise a laser cutting device 120 adapted to move into the operating configuration at these seats in order to cut the first and second tabs 100, 101 alternately and in sequence from the first web 103 and the second web 102, respectively, by means of a laser beam 122.

The unit 1 comprises feeding means for the first web 103 and the second web 104, mounted upstream of the forming and spacing drum 2, for feeding the first web 103 and the second web 104 to the forming and spacing drum 2.

Figure 3:
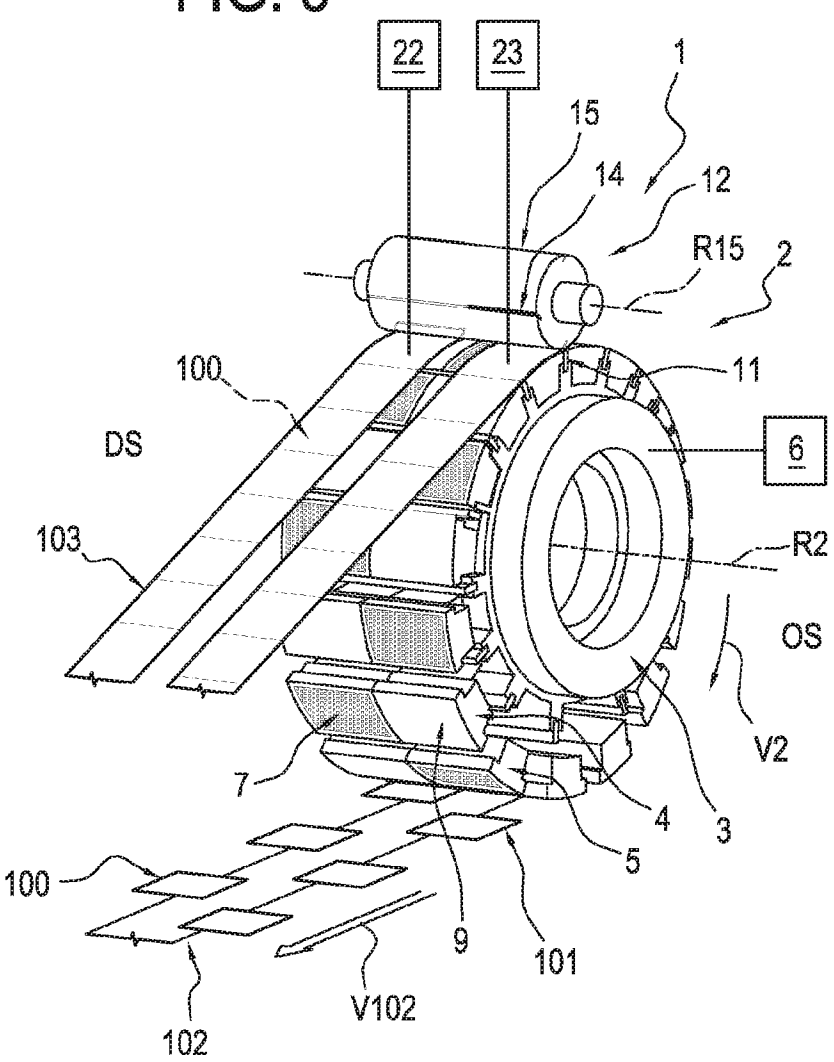
Figure 2:
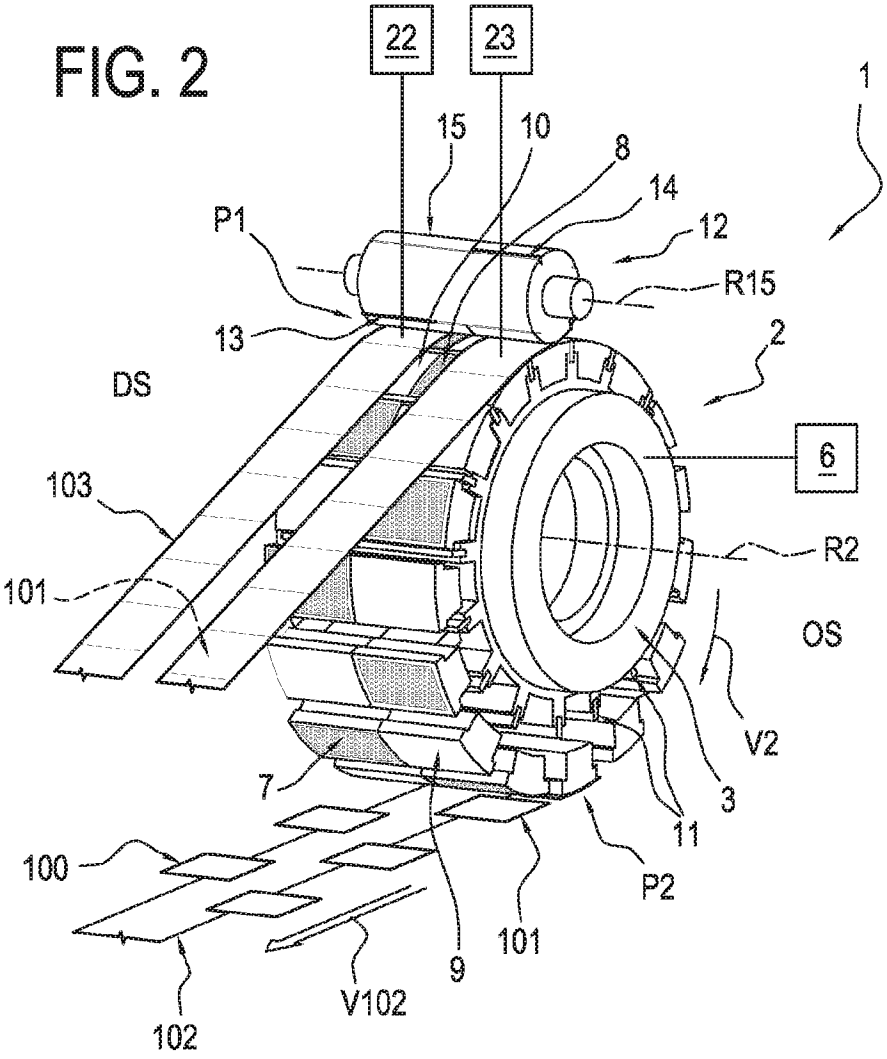
Figure 4:
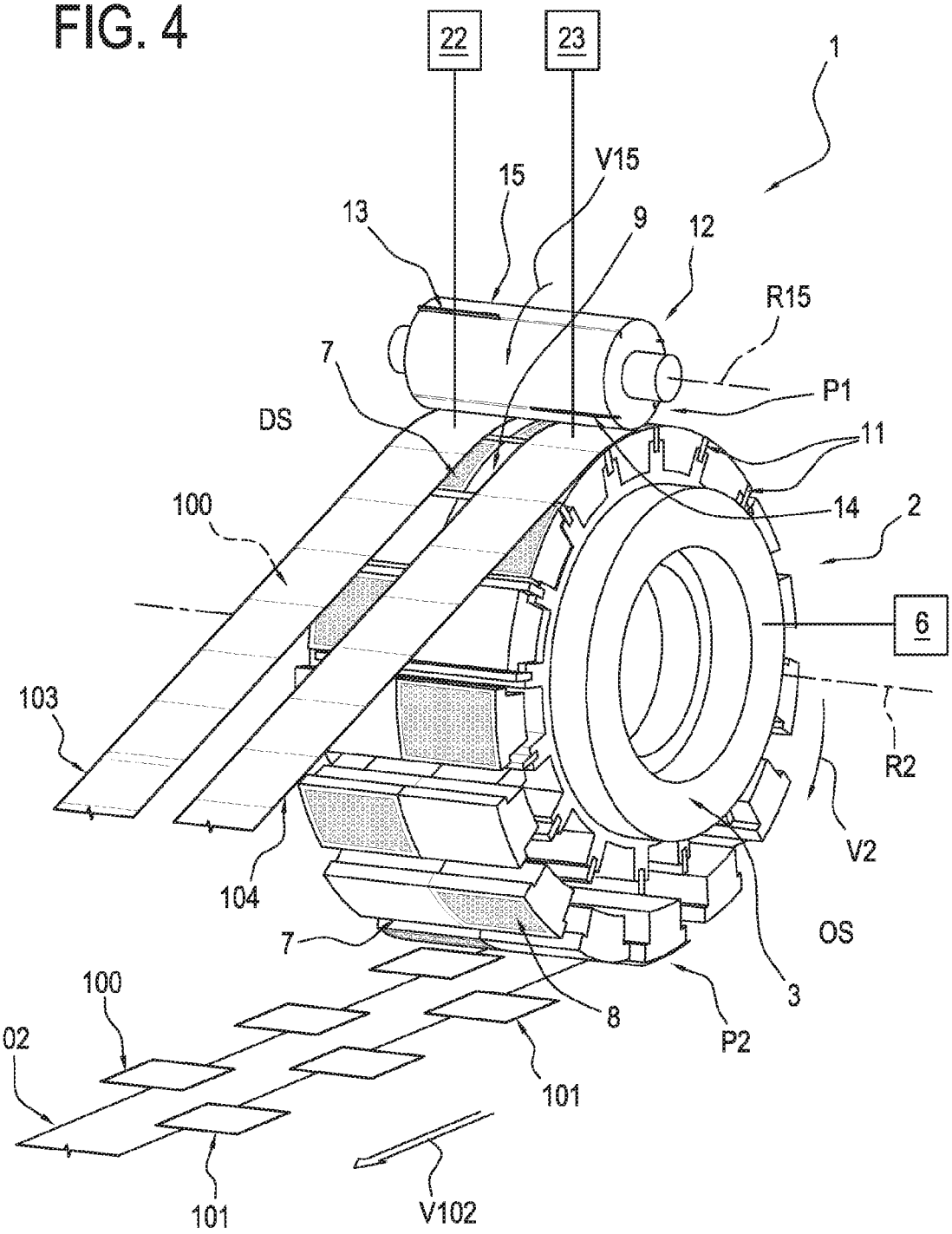

More specifically, the unit 1 comprises a first system 16 for feeding the web 103 to the drum 2 and a second system 17 for feeding the web 104 to the drum 2, both schematically represented as blocks in FIGS. 2, 3 and 4.

The systems 16 and 17 feed the respective webs 103 and 104 intermittently to the drum 2 and/or to the cutting device 12.

The system 16 comprises a continuous feeder 18 of substantially known type for feeding the first web 103 to the drum 2 and a continuous feeder 19 of substantially known type for feeding the second web 104 to the drum 2.

In alternative embodiments, the unit 1 comprises a single continuous feeding device for both webs 103 and 104.

The unit 1 comprises a first buffer device 20, of substantially known type and described only insofar as necessary to understand this invention, interposed between the feeder 18 and the drum 2, to make feeding of the first continuous web 103 to the cutting device 12 intermittent.

Figure 5:
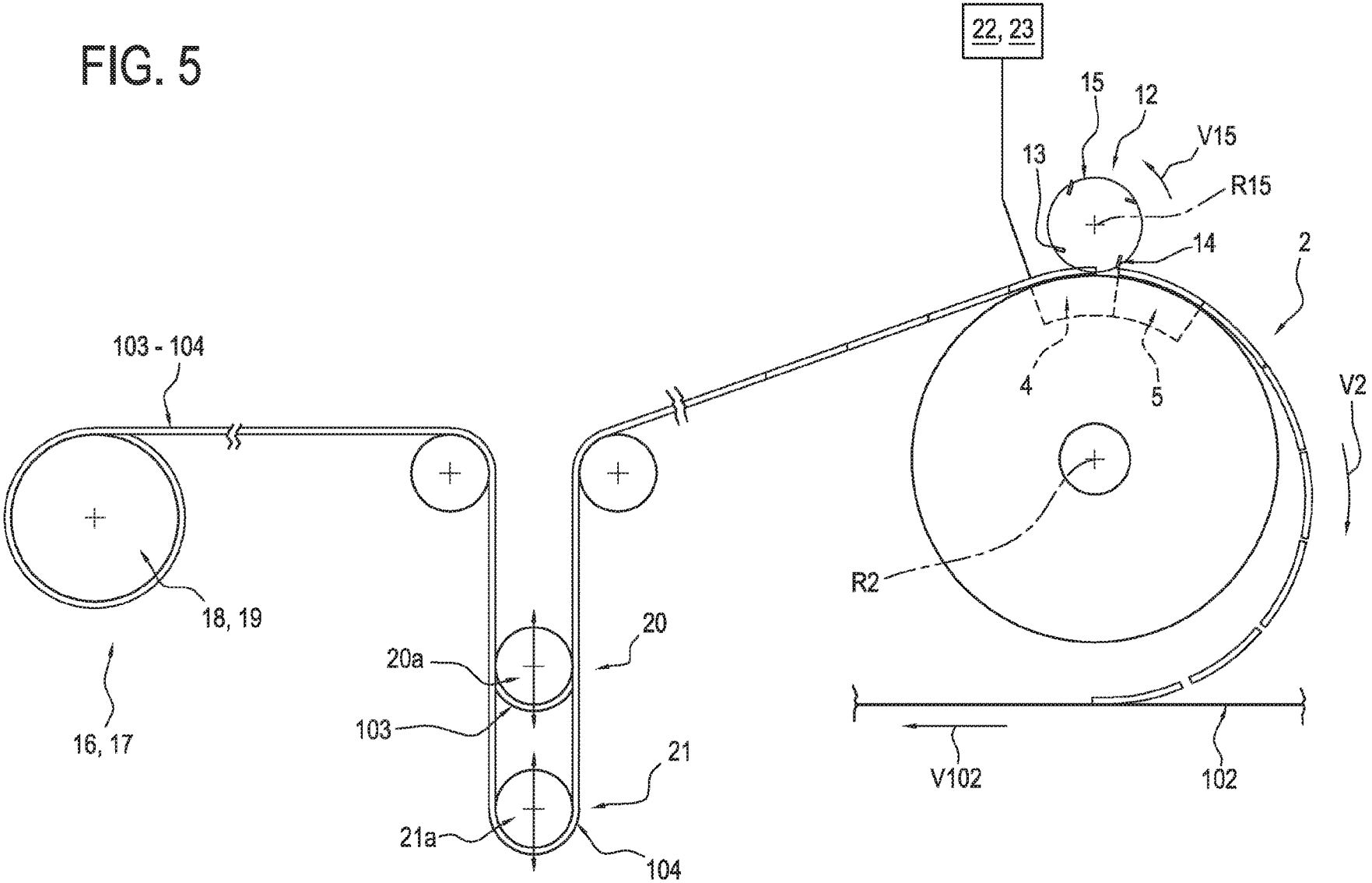
FIG. 5 is a schematic side view, with some parts in blocks and others cut away for clarity, of the applicator unit of the preceding figures.

In practice, with reference to FIG. 5, when feeding of the web 103 to the cutting device 12 needs to be stopped, the web is fed to the buffer system 20, for example by lowering a roller 20*a*.

The unit 1 comprises a second buffer device 21, of substantially known type and described only insofar as necessary to understand this invention, interposed between the feeder 19 and the drum 2, to make feeding of the second continuous web 104 to the cutting device 12 intermittent.

In practice, with reference to FIG. 5, when feeding of the web 104 to the cutting device 12 needs to be stopped, the web is fed to the buffer system 21, for example by lowering a roller 21*a*.

In the configuration illustrated for example, the web 103 is being fed to the device 12 whilst the web 104 is fed to the corresponding buffer system 21.

In practice, both the web 103 and the web 104 are fed intermittently to the drum 2 to obtain the required distribution of the tabs on the chassis web 102 since the web 102 itself is fed continuously.

In other words, the webs 103 and 104 are fed to the drum 2 one at a time in the manner described in more detail below.

The first and second buffer devices 20, 21 are movable between a feeding position, in which the first and second webs 103, 104 are fed to the forming and spacing drum 2, and an accumulation position, in which the first and second webs 103, 104 are accumulated in the first and second buffer devices 20, 21, respectively, interrupting feed to the forming and spacing drum 2.

The first and second buffer devices 20, 21 move alternately between the feeding position and the accumulation position and vice versa in such a way that when the first buffer device 20 or the second buffer device 21 is in one of these positions, the other buffer device 20, 21 is in the opposite position.

To prevent the webs 103 and 104 from slipping off the drum 2 as a result of cutting operations, the unit 1 comprises a retaining system for retaining the first web 103 and the second web 104, mounted upstream of the cutting means and opposing the lateral surface of the drum 2 in such a way as to define a passage through which the first web 103 and the second web 104 are fed to the cutting means.

The retaining system is operatively connected to the forming and spacing drum 2 to retain the first web 103 and the second web 104 alternately when they are positioned on the respective passive portion 9, 10 during the rotation of the forming and spacing drum 2 at the cutting means.

More specifically, the retaining system 22, 23 is synchronized with the forming and spacing drum 2 in such a way as to retain the first web 103 and the second web 104 alternately when the passive portions of the corresponding carriers 4, 5 are positioned upstream and at the cutting means and the respective first or second buffer device 20, 21 moves between the feeding position and the accumulation position.

In the embodiment illustrated, the unit 1 comprises a first retaining system 22 for holding the web 103 on the drum 2 and a second retaining system 23 for holding the web 104 on to the drum 2, both schematically represented as blocks in the drawings.

The retaining systems 22 and 23 operate upstream of the cutting device 12 in the feed direction V2 in order to hold the webs 103 and 104 on the drum 2.

In one embodiment, the retaining system 22 is movable between a first operating position, for example a raised position, where the web 103 is free to move and is fed by the suction portions 7 of the carriers 4 towards the cutting device 12, and a second operating position, for example a lowered position, where the web 103 is held on the drum 2.

More specifically, the retaining system 22 is synchronized with the drum 2 in such a way as to hold the web 103 on the second, non-suction portions 10 of the second carriers 5 when the web 103 is also held still by the buffer system 20, that is to say, is not fed to the cutting device 12.

In one embodiment, the retaining system 22 is movable between a first operating position, for example a raised position, where the web 104 is free to move and is fed by the suction portions 8 of the carriers 5 towards the cutting device 12, and a second operating position, for example a lowered position, where the web 104 is held on the drum 2.

More specifically, the retaining system 23 is synchronized with the drum 2 in such a way as to hold the web 104 on the non-suction portions 9 of the first carriers 4 when the web 104 is also held still by the buffer system 21, that is to say, is not fed to the cutting device 12.

In use, starting from the configuration of FIG. 1, the web 103 is fed to the cutting device 12 by the suction portion 7 of the vacuum pad 4 immediately upstream of the cutting device 12.

The web 103 is free to move forward, that is to say, the retaining system 22 is in the first operating position and the buffer system 20 is not being supplied.

At the same time, the web 104 is stationary, that is to say, it is going into the buffer system 21, and the web 104 is held by the retaining system 23 on the drum 2, in particular on the non-suction portion 9 of the vacuum pad 4 immediately upstream of the cutting device 12, that is, on the non-suction portion 9 of the vacuum pad 4 which feeds the web 103.

It should be noted that, in practice, the drum 2 with the non-suction portion 9 on it slides under the web 104, which is stationary.

With reference to FIG. 2, the web 103 has substantially reached the cutting device 12, with the web 104 still stationary, where a piece 100 defining a first tab 100 is cut and held in place by the corresponding vacuum pad 4 on the drum 2 which feeds it until it is applied to the chassis web 102.

With reference to FIG. 3, immediately after cutting off the piece 100, the retaining system 22 moves to the second operating position and stops the web 103 on the drum 2, on a non-suction portion 10 of the vacuum pad 5 immediately upstream of the cutting device 12.

Under these circumstances, the web 103 is also fed to the buffer system 20 in such a way as to be stationary on the drum 2.

At the same time, the retaining system 23 moves into the first operating configuration to release the web 104 and stop feeding it to the buffer system 21, that is to say, for example, the roller 21*a* rises again and the web 104 is fed to the drum 2.

The web 104 is held on drum 2 by the suction portion 8 of the carrier 5 immediately upstream of the cutting device 12 and from there is fed towards the cutting device 12.

The carrier 5 which feeds the web 104 with its suction portion 8 is the same one on which the web 103 was stopped before that.

With reference to FIG. 4, the web 104 is fed to the cutting device 12, where a piece 101 defining a corresponding tab is cut from the web 104 itself and fed until it is applied to the chassis web 102.

The web 103 remains stationary and held on the drum 2 by the retaining system 22 until the unit 1 returns to a configuration substantially corresponding to that shown in FIG. 1.

In practice, two continuous strips of material, defined by the webs 103 and 104, are fed in from left to right, looking at the accompanying drawings, between the anvils 11 and the blades 13 and 14, with intermittent feed motion in such a way as to supply a suitable quantity of tabs 100, 101 alternately to each side of the chassis web 102.

Preferably, an axial plane of the applicator drum 2 lies on what is referred to as the machine axis and the drum 2 itself is preferably made wide enough to cover all the possible positions occupied by the tabs in transverse direction for the different sizes of nappies to be made.

Advantageously, the above mentioned method of feeding the webs 103, 104 is associated with a minimum amount of sliding due to the need to supply, for each side of the chassis web 102, a length of material corresponding to one tab every two anvils 11.

The amount of sliding is minimal because at first, the web 103, 104 which remains stationary, slides on the non-suction portions 9, 10 instead of on the suction portions as in known solutions.

The law of motion associated with the alternating movement with which each side of the chassis web 102 is fed is constructed in such a way as to limit as much as possible the sliding between the vacuum pad 4, 5 and the material of the webs 103, 104, in particular even when that material is at positions beyond the cutting point before cutting actually occurs.

Preferably, to limit sliding even when the material of the webs 103, 104 is at the positions preceding the cutting point, a shaped belt, not illustrated, is used to direct the web 103, 104 towards the cutting point in a plane at right angles to a plane passing through the axes of rotation R15, R2 of the roller 15 and drum 2 and to minimize the contact arc between the webs 103, 104 and the vacuum pads 4, 5.

Advantageously, thanks to the fact that cutting occurs every two passes of the continuous webs 103, 104 over the anvils 11 for each side of the chassis web 102, the individual tabs 100, 101 are provided with a favourable pre-spacing.

In other words, the applicator drum 2 and the cutting device 12 are synchronized in such a way that the first and second continuous webs 103, 104 are cut alternately on consecutive anvils 11 during the rotation of the drum 2 itself.

The passage of the tabs 100, 101 from the applicator drum 2 to the web 102 occurs without varying the speed thanks to the radial lifting of the carriers 4, 5.

The invention claimed is:

1. A unit for forming and spacing first and second tabs obtained, respectively, from a first web and a second web, comprising:

a forming and spacing drum configured to move the first web and the second web arranged in juxtaposition along a lateral surface of the forming and spacing drum during a rotation about an axis of rotation, the forming and spacing drum including a plurality of carriers distributed along the lateral surface and each comprising an active portion including a suction mechanism for holding the webs, and a passive portion, without the suction mechanism, placed side by side along a placement direction parallel to the axis of rotation;

a feeding system for the first web and the second web mounted upstream of the forming and spacing drum for feeding the first web and the second web to the forming and spacing drum, the feeding system including a feed roller for feeding the first web and the second web;

a cutting system including at least one blade and adapted for arrangement in an operating configuration with the forming and spacing drum to cut the first and second tabs alternately and in sequence from the first web and the second web, respectively;

wherein the positions of the active and passive portions of two consecutive carriers of the plurality of carriers are inverted with each other along the placement direction in such a way as to alternate an active portion and a passive portion along a stretch of the lateral surface on which the first web or the second web is moving during the rotation of the forming and spacing drum about the axis of rotation;

wherein the forming and spacing drum includes a plurality of anvils, each interposed between the two consecutive carriers of the plurality of carriers, and wherein the cutting system is configured for moving into the operating configuration in contact with the plurality of anvils in order to cut the first and second tabs alternately and in sequence from the first web and the second web, respectively.

2. The forming and spacing unit according to claim 1, wherein the feeding system further comprises a buffer system interposed between the feed roller and the forming and spacing drum, the buffer system comprising a first buffer device including at least one first roller for the first web and a second buffer device including at least one second roller for the second web, adapted for intermittent feeding while the cutting system is arranged in the operating configuration.

3. The forming and spacing unit according to claim 2, wherein the first and second buffer devices are movable between a feeding position, in which the first and second webs are fed to the forming and spacing drum, and an accumulation position, in which the first and second webs are accumulated in the first and second buffer devices, respectively, interrupting feed to the forming and spacing drum, the first and second buffer devices moving alternately between the feeding position and the accumulation position and vice versa in such a way that when the first buffer device or the second buffer device is in one of the feeding and accumulation positions, the other buffer device is in the other of the feeding and accumulation positions.

4. The forming and spacing unit according to claim 1, wherein the at least one blade includes a rotary cutting roller rotating about an axis of rotation parallel to the axis of rotation of the forming and spacing drum, the cutting roller comprising at least a first blade to cut the first web and at least a second blade to cut the second web, wherein the first and second blades extend for a stretch corresponding to a transverse extension of the corresponding first or second web to be cut, in the placement direction, and are offset along the lateral surface of the cutting roller to move alternately and consecutively.

5. The forming and spacing unit according to claim 1, wherein the plurality of carriers are movable radially relative to the axis of rotation of the forming and spacing drum between a cutting position, to allow cutting at the cutting system, and a depositing position, where a distance of the lateral surface of the plurality of carriers from the axis of rotation of the forming and spacing drum is greater in the depositing position than in the cutting position.

6. A unit for forming and spacing first and second tabs obtained, respectively, from a first web and a second web, comprising:

a forming and spacing drum configured to move the first web and the second web arranged in juxtaposition along a lateral surface of the forming and spacing drum during a rotation about an axis of rotation, the forming and spacing drum including a plurality of carriers distributed along the lateral surface and each comprising an active portion including a suction mechanism for holding the webs, and a passive portion, without the suction mechanism, placed side by side along a placement direction parallel to the axis of rotation;

a feeding system for the first web and the second web mounted upstream of the forming and spacing drum for feeding the first web and the second web to the forming and spacing drum, the feeding system including a feed roller for feeding the first web and the second web;

a cutting system including at least one blade adapted for arrangement in an operating configuration with the forming and spacing drum to cut the first and second tabs alternately and in sequence from the first web and the second web, respectively;

wherein the positions of the active and passive portions of two consecutive carriers of the plurality of carriers are inverted with each other along the placement direction in such a way as to alternate an active portion and a passive portion along a stretch of the lateral surface on which the first web or the second web is moving during the rotation of the forming and spacing drum about the axis of rotation;

wherein the forming and spacing drum includes a plurality of opposing blades, each interposed between the two consecutive carriers of the plurality of carriers, and wherein the cutting system is adapted to move into the operating configuration in contact with the plurality of opposing blades in order to cut the first and second tabs alternately and in sequence from the first web and the second web, respectively.

7. A unit for forming and spacing first and second tabs obtained, respectively, from a first web and a second web, comprising:

a forming and spacing drum configured to move the first web and the second web arranged in juxtaposition along a lateral surface of the forming and spacing drum during a rotation about an axis of rotation, the forming and spacing drum including a plurality of carriers distributed along the lateral surface and each comprising an active portion including a suction mechanism for holding the webs, and a passive portion, without the suction mechanism, placed side by side along a placement direction parallel to the axis of rotation;

a feeding system for the first web and the second web mounted upstream of the forming and spacing drum for feeding the first web and the second web to the forming and spacing drum, the feeding system including a feed roller for feeding the first web and the second web;

a cutting system including a laser adapted for arrangement in an operating configuration with the forming and spacing drum to cut the first and second tabs alternately and in sequence from the first web and the second web, respectively;

wherein the positions of the active and passive portions of two consecutive carriers of the plurality of carriers are inverted with each other along the placement direction in such a way as to alternate an active portion and a passive portion along a stretch of the lateral surface on which the first web or the second web is moving during the rotation of the forming and spacing drum about the axis of rotation;

wherein the forming and spacing drum includes a plurality of seats, each interposed between the two consecutive carriers of the plurality of carriers, and wherein the cutting system comprises the laser for producing, in the operating configuration, a laser beam at the seats in order to cut the first and second tabs alternately and in sequence from the first web and the second web, respectively.

* * * * *